US009103054B2

(12) United States Patent
Shan et al.

(10) Patent No.: US 9,103,054 B2
(45) Date of Patent: Aug. 11, 2015

(54) MULTI-DIMENSIONAL WEAVING SHAPING MACHINE OF COMPOSITE MATERIALS

(75) Inventors: Zhongde Shan, Beijing (CN); Xiwen Li, Beijing (CN); Feng Liu, Beijing (CN); Juanjuan Qiao, Beijing (CN); Haibo Chen, Beijing (CN); Shaoyan Qin, Beijing (CN)

(73) Assignee: Advanced Manufacture Technology Center, China Academy Of Machinery Science & Technology, Beijing (CN)

( * ) Notice: Subject to any disclaimer, the term of this patent is extended or adjusted under 35 U.S.C. 154(b) by 0 days.

(21) Appl. No.: 14/369,630

(22) PCT Filed: Jun. 7, 2012

(86) PCT No.: PCT/CN2012/076582

§ 371 (c)(1),
(2), (4) Date: Jun. 27, 2014

(87) PCT Pub. No.: WO2013/097415

PCT Pub. Date: Jul. 4, 2013

(65) Prior Publication Data

US 2014/0360618 A1 Dec. 11, 2014

(30) Foreign Application Priority Data

Dec. 31, 2011 (CN) ..... 2011 1 0460621

(51) Int. Cl.
*D03D 3/00* (2006.01)
*D03D 41/00* (2006.01)
(Continued)

(52) U.S. Cl.
CPC ..... *D03D 41/004* (2013.01); *D03D 25/005* (2013.01); *D04C 3/02* (2013.01); *D04C 1/04* (2013.01); *D04C 3/04* (2013.01)

(58) Field of Classification Search
CPC ... D03D 41/004; D03D 25/005; D03D 41/00; D10B 2505/02; D10B 2403/02; D04H 3/04; D04H 3/05; Y10S 139/01; Y10T 442/3195
See application file for complete search history.

(56) References Cited

U.S. PATENT DOCUMENTS 3,955,602 A * 5/1976 King ..... 139/11
4,594,122 A * 6/1986 McConnell ..... 156/433
(Continued)

FOREIGN PATENT DOCUMENTS

CN 102191627 A 9/2011
EP 0341575 A2 11/1989
FR 2884836 A1 10/2006

OTHER PUBLICATIONS

International Search Report (Form PCT/ISA/210) for PCT/CN2012/076582, completed Sep. 11, 2012.

*Primary Examiner* — Bobby Muromoto, Jr.
(74) *Attorney, Agent, or Firm* — Koppel, Patrick, Heybl & Philpott

(57) ABSTRACT

A multi-dimensional weaving shaping machine of composite materials, including: a guide template including a plurality of cylindrical guiders arranged according to the geometrical shape of a prefabricated member; an electrical control three-dimensional motion mechanism including: a control signal receiving terminal configured to receive motion control signals corresponding to the geometrical shape of the prefabricated member; and a three-dimensional motion output terminal configured to form a motion track according to the motion control signals; a weaving needle being connected with the three-dimensional motion output terminal and making weave fibers distribute among the cylindrical guiders according to the geometrical shape of the prefabricated member. The multi-dimensional weaving shaping machine of composite materials of the disclosure utilizes the cylindrical guiders and the electrical control three-dimensional motion mechanism to make the weaving needle to drive braided cords to distribute among the cylindrical guiders along the motion track to form the guide template.

21 Claims, 13 Drawing Sheets

(51) Int. Cl.

| | |
|---|---|
| ***D04C 3/02*** | (2006.01) |
| *D03D 25/00* | (2006.01) |
| *D04C 1/04* | (2006.01) |
| *D04C 3/04* | (2006.01) |

(56) References Cited

U.S. PATENT DOCUMENTS

| | | | | |
|---|---|---|---|---|
| 4,615,256 | A * | 10/1986 | Fukuta et al. | 87/33 |
| 4,936,186 | A * | 6/1990 | Sekido et al. | 87/8 |
| 5,767,023 | A * | 6/1998 | Berger et al. | 442/205 |
| 5,987,929 | A * | 11/1999 | Bostani | 66/1 R |
| 6,105,622 | A * | 8/2000 | Sternheim et al. | 139/11 |
| 7,077,167 | B2 * | 7/2006 | Nayfeh et al. | 139/11 |
| 8,600,541 | B2 * | 12/2013 | Shan et al. | 700/131 |
| 8,655,475 | B2 * | 2/2014 | Shan et al. | 700/140 |
| 2013/0073074 | A1 * | 3/2013 | Shan et al. | 700/131 |
| 2013/0166058 | A1 * | 6/2013 | Shan et al. | 700/140 |

* cited by examiner

MULTI-DIMENSIONAL WEAVING SHAPING MACHINE OF COMPOSITE MATERIALS

TECHNICAL FIELD OF THE INVENTION

The disclosure relates to the technical field of weaving shaping of composite materials, and more particularly to a multi-dimensional weaving shaping machine of composite materials.

BACKGROUND OF THE INVENTION

As part of strategic emerging industries in China, high-strength fibers including carbon fibers, aramid fibers, polyethylene and fiberglass and the composite material products thereof have the advantages of light weight, high strength, corrosion resistance and unique concealment performance etc. Composite materials, which are widely applied in fields including wind energy, aeronautics and astronautics, automobiles, railway communication, buildings, weapons, armors, ships, chemical engineering and sports etc., have been an important fiercely-competitive industry that is developed by countries all over the world as a priority. Composite materials are basic key materials in sophisticated industries including aeronautics and astronautics etc. For example, composite material technology are the most critical technology in the competition between Boeing and Airbus as well as one of the major bottlenecks of civil aircraft projects in China. The composite materials used in Boeing 787 already account for more than 50% of the total mass of the plane. Shells of stealth fighters are basically made of microwave absorbing composite materials. In the meanwhile, composite materials are one of the basic factors for stealth of planes and naval vessels. Although having many excellent performances, the following disadvantages need to be overcome to expand the application of composite materials:

1. Easy Interlaminar Cracking

Most existing fiber composite materials are produced by superimposing fiber sheets including fiber cloth and prepregs etc. to a certain thickness and cure the fiber sheets by resin substrates. Thanks to the ultra-high strength fibers on the surfaces in 2 dimensions of the sheets, strength of the sheets are several times stronger than that of steel and may reach above 3000 MPa. However, there are resin plastic substrates among the sheets, and the interlaminar strength are extremely low at just 100 MPa. The difference between the fiber strength in the layers and the plastic strength among the layers is as much as more than 30 times. Therefore, easy interlaminar cracking is an intrinsic disadvantage of fiber composite materials. Because of the weak interlaminar strength, as well as the relatively low impact strength and compressive strength, interlaminar cracking is the main failure of composite materials, especially when impacted and compressed to cause fatigue.

Methods including interlaminar stitching, three-dimensional spinning and three-dimensional weaving etc. may be applied in order to improve the interlaminar strength of composite materials. Although some achievements have been made in the research and development, these technologies have complicated processes together with very high cost and limited use. Nevertheless, broadly-applied multi-axial warp knitted composite materials fail to obtain three-dimensional structures due to the thickness limitation. So, interlaminar cracking is the major disadvantage that harasses the performance of composite materials. Therefore, it's been a problem in the world to enhance the interlaminar strength of composite materials at low costs.

2. Low Lamination Efficiency and High Labor Costs

Usually, if long staples are required to be used as structural materials, fiber sheets are manufactured by yarns and composite material plates or products are produced by superimposing layers of fiber sheets to a certain thickness. Processes of production of yarns, fabrics, plies/composites are necessary in the application of long staples as materials. However, only the process of fabricating yarns into fabrics can be realized efficiently by spinning techniques in the whole production process of fiber composite material products. Since fiber sheets can be hardly operated automatically and mechanically, expensive automatic fiber orientation devices can be applied only in sophisticated industries that require very high lamination accuracy of fiber sheets, such as aircraft manufacturing. Therefore, fiber sheets are mostly laminated into plates and products manually in the industry of composite materials, which is low in production efficiency and high in labor cost, wherein the low manual lamination efficiency has always been the main bottleneck of the production process of composite materials.

3. Expensive High-Strength Fibers Including Carbon Fibers, Aramid Fibers and High-Modulus Polyethylene Etc.

The low interlaminar strength, the low lamination efficiency and the high labor costs of lamination processes of fiber composite materials result in limited application of composite materials and limited demands of high-strength fibers including carbon fibers, aramid fibers and high-modulus polyethylene etc. that are mainly used in high-end products in the market. Along with the technical monopoly of developed countries on carbon fibers, aramid fibers and high-modulus polyethylene, these high-strength fibers are naturally very expensive. The good news is that production problems of carbon fibers and high-modulus polyethylene have been solved in China in recent years to realize localization, and aramid fibers will be produced at home soon.

If the interlaminar strength of composite materials are improved and composite materials can be laminated automatically at low costs, the application demands of composite materials will increase inevitably, the yields of carbon fibers, aramid fibers and high-modulus polyethylene will be also increased greatly and their manufacturing costs are expected to decrease.

SUMMARY OF THE INVENTION

The objective of the disclosure is to provide a multi-dimensional weaving shaping machine of composite materials to solve the technical problem of the lack of highly-automatic manufacturing devices capable of fabricating high-strength composite materials in the prior art.

To realize the objective above, the disclosure provides a multi-dimensional weaving shaping machine of composite materials, including: a guide template including a plurality of cylindrical guiders arranged according to the geometrical shape of a prefabricated member; an electrical control three-dimensional motion mechanism located above the guide template, and including: a control signal receiving terminal configured to receive motion control signals corresponding to the geometrical shape of the prefabricated member; and a three-dimensional motion output terminal configured to form a motion track according to the motion control signal; a weaving mechanism including: a weaving needle being connected with the three-dimensional motion output terminal for driving weave fibers to move among the cylindrical guiders along the motion track so that the weave fibers are distributed among the cylindrical guiders according to the geometrical shape of the prefabricated member.

Further, the guide template includes a weaving plate, on which a plurality of uniformly-distributed first through holes are provided; a perforated plate is set below the weaving plate; a plurality of guide columns of which the heights are adjustable heights are set below the perforated plate; the perforated plate is provided with a plurality of second through holes coaxially corresponding to the first through holes; the guide columns pass through the first through holes and the second through holes; the cylindrical guiders are cylindrical sleeves which are sleeved on the guide columns and provided with optional heights.

Further, a pneumatic chuck for clamping the weaving needle, the cylindrical guiders and/or the guide columns is set on the three-dimensional motion output terminal.

Further, each of the guide columns is provided with clamping grooves distributed axially at equal intervals. A moveable adjusting plate is set below the perforated plate. A guide column support plate that is static relative to the perforated plate is set below the moveable adjusting plate. The moveable adjusting plate is capable of sliding relative to the perforated plate. A plurality of elongated and round apertures opposite to the second through holes of the perforated plate are set on the moveable adjusting plate. The guide columns pass through the elongated and round apertures and move in the elongated and round apertures with the movement of the moveable adjusting plate.

Further, locking members matched with the clamping grooves are set on the moveable adjusting plate. The moveable adjusting plate has a locking position to match the locking members with the clamping grooves so as to lock the heights of the guide columns and an unlocking position to separate the locking members and the clamping grooves.

Further, the locking member is a leaf spring set at an end of the extension direction of the elongated and round aperture and obliquely extending to the guide column located in the elongated and round aperture. The clamping grooves are formed by the conical portions of the guide column and flanges set on the small-diameter ends of the conical portions.

Further, a first support framework is set below the moveable adjusting plate. The first support frame is provided with a first support frame located on the periphery of the moveable adjusting plate. A locating plate is set on the first support frame. The side face of the locating plate is provided with an adjusting screw rod extending horizontally. The first end of the adjusting screw rod is fixedly connected with the moveable adjusting plate.

Further, the bottom surface of the moveable adjusting plate is provided with a shifting yoke. The first end of the adjusting screw rod is fixedly connected with the moveable adjusting plate through the shifting yoke, and the second end of the adjusting screw rod is provided with an adjusting handle.

Further, a connecting hole configured to connect the first support frame is further set on the locating plate.

Further, the first support framework includes four first support legs, and the guide column support plate is located between the four first support legs.

Further, a plurality of locating sleeves coaxially matched with the second through holes are further provided on the perforated plate, and the guide columns pass through the locating sleeves.

Further, the upper end of the guide column is provided with first annular platform extending outwards along the radial direction.

Further, the periphery of the cylindrical guider is provided with a plurality of layers of ring grooves for limiting the positions of the weave fibers.

Further, the upper end of the cylindrical guider is provided with a second annular platform extending outwards along the radial direction.

Further, the electrical control three-dimensional motion mechanism further includes: an X axis motion unit including an X supporter extending along a first direction; an X axis guide rail set on the X axis supporter; an X axis synchronous belt motion mechanism set along the X axis guide rail and provided with an X axis slider; a Y axis motion unit including: a Y axis supporter connected with the X axis slider and extending along a second direction vertical to the first direction; a Y axis guide rail set on the Y axis supporter; a Y axis synchronous belt motion mechanism set along the Y axis guide rail and provided with a Y axis slider; a Z axis motion unit including: a Z axis supporter extending along a third direction vertical to the plane formed by the first direction and the second direction; a Z axis guide rail set on the Z axis supporter; a Z axis synchronous belt motion mechanism set along the Z axis guide rail and provided with a Z axis slider; the Z axis slider is fixedly connected with the Y axis slider, wherein a three-dimensional motion output terminal is formed at the lower end of the Z axis supporter.

Further, the X axis supporter includes a first supporter and a second supporter in parallel. The X axis guide rail includes a first guide rail and a second guide rail set on the first supporter and the second supporter, respectively. The X axis synchronous belt motion mechanism is set on the first supporter. The synchronous belt of the X axis synchronous belt motion mechanism is connected with the first end of the Y axis supporter. The X axis slider includes a first slider located on the first guide rail and a second slider located on the second guide trail. The first slider and the second slider are located below the first end and the second end of the Y axis supporter, respectively.

Further, the multi-dimensional weaving shaping machine of composite materials in the disclosure further includes a cylindrical guider storage shelf located at the first side of the guide template. The cylindrical guider storage shelf includes a guider storage support bracket and a storage plate set on the guider storage support bracket. A plurality of cylindrical guiders with different heights are pre-stored on the storage plate.

Further, a plurality of uniformly-distributed threaded holes are provided on the storage plate. Storage support rods for supporting the cylindrical guiders are provided in the threaded holes. The lower ends of the storage support rods are provided with external threads matched with the threaded holes.

Further, the weaving mechanism further includes a fiber yarn feeding and tensioning mechanism located at the second side of the guide template.

Further, the fiber yarn feeding and tensioning mechanism includes: a third bracket; a fiber roll installation bracket set on a support beam of the third bracket and provided with support rods for supporting fiber rolls; tension pulley base plates set on the support beam of the third bracket. A tension pulley for providing fiber yarns to the weaving needle and a guide pulley are provided on each of the tension pulley base plate.

Further, the fiber yarn feeding and tensioning mechanism further comprises a weaving needle base for storing the weaving needle and the weaving needle base is located on one side of the tension pulley base plate.

The disclosure has the following beneficial effect:

The multi-dimensional weaving shaping machine of composite materials of the disclosure utilizes the cylindrical guiders and the electrical control three-dimensional motion mechanism to make the weaving needle to drive braided cords to distribute among the cylindrical guiders along the motion track to form the guide template. The machine is applicable to multi-dimensional weaving shaping of large-scale and complicated materials and capable of improving the interlaminar strength of composite materials. The shaping machine applies a rapid shaping technology to multi-dimensional weaving shaping of composite materials and the technical processes are automatic.

Besides the objectives, characteristics and advantages described above, the disclosure has other objectives, characteristics and advantages. The disclosure will be described in details below with reference to the drawings.

BRIEF DESCRIPTION OF THE DRAWINGS

The accompanying drawings that constitute a part of the application are used for providing further understanding to the disclosure. The exemplary embodiments of the disclosure and the illustrations thereof are used for explaining the disclosure, instead of constituting an improper limitation to the disclosure. In the accompanying drawings.

DETAILED DESCRIPTION OF THE EMBODIMENTS

The embodiments of the disclosure will be described below in combination with the accompanying drawings. However, the disclosure can be implemented by many different methods limited and covered by the claims.

Figure 1:
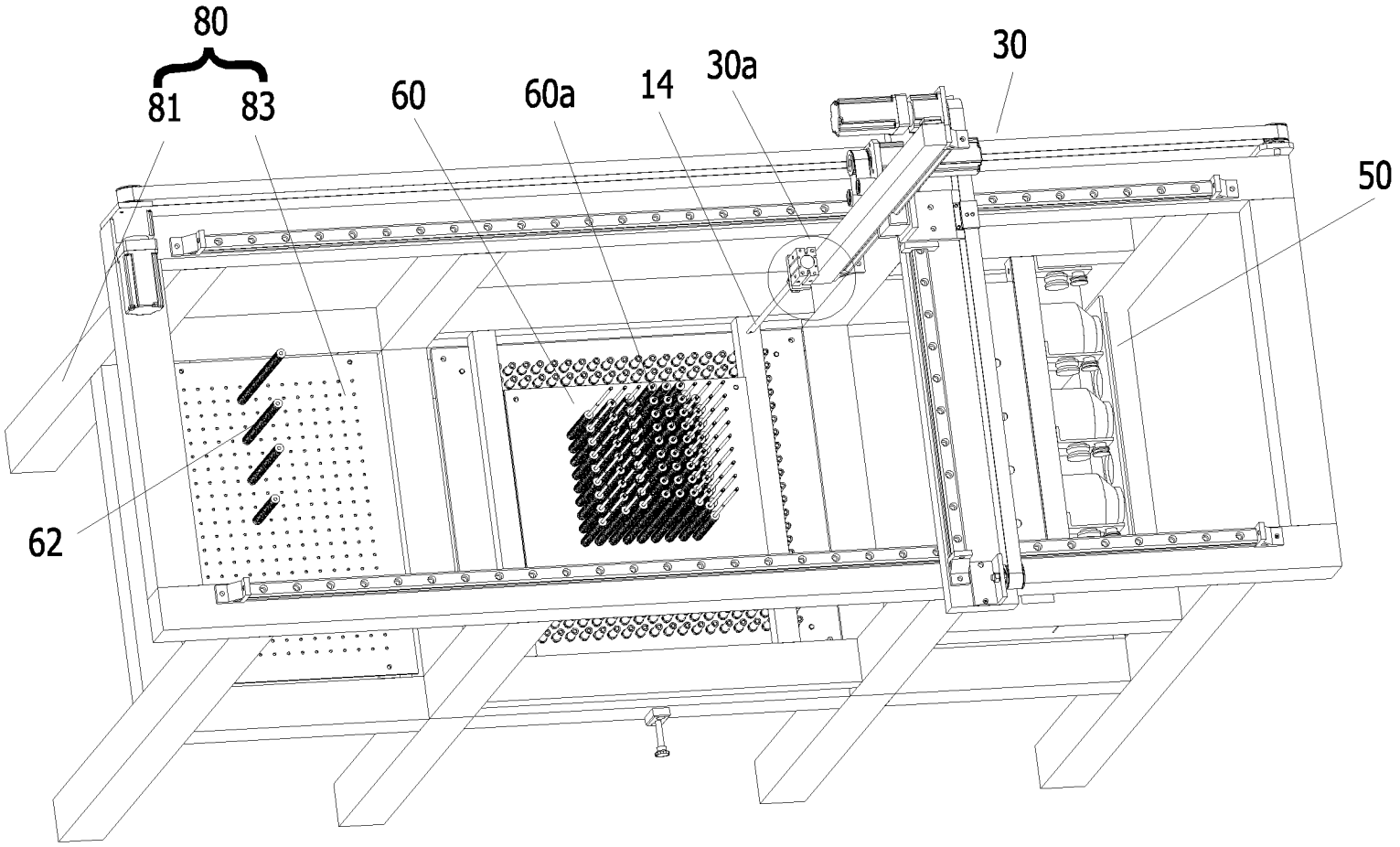
FIG. 1 is a schematic diagram illustrating a stereo structure of a multi-dimensional weaving shaping machine of composite materials in a preferred embodiment of the disclosure.

As shown in FIG. 1, the disclosure provides a multi-dimensional weaving shaping machine of composite materials, including: a guide template 60, wherein the guide template 60 includes a plurality of cylindrical guiders 62 arranged according to the geometrical shape of prefabricated member; an electrical control three-dimensional motion mechanism 30 located above the guide template 60, wherein the electrical control three-dimensional motion mechanism 30 includes: a control signal receiving terminal configured to receive motion control signals; a three-dimensional motion output terminal 30*a* configured to form a motion track according to the motion control signals. The multi-dimensional weaving shaping machine of composite materials of the disclosure further includes: a weaving mechanism 50. The weaving mechanism 50 includes: a weaving needle 14 connected with the three-dimensional motion output terminal 30*a* and driving weave fibers to distribute among the cylindrical guiders 62 along the motion track.

Figure 2:
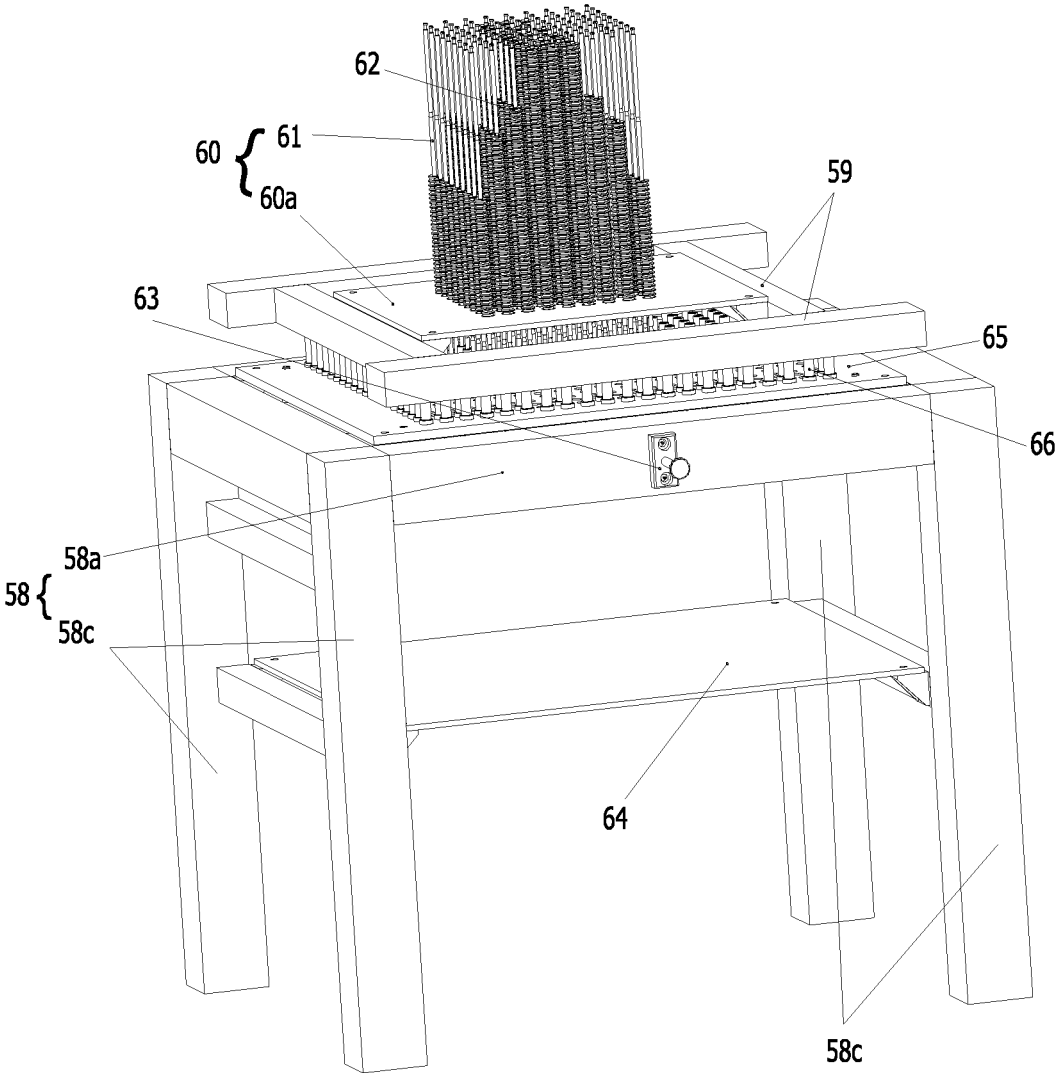
FIG. 2 is a schematic diagram illustrating a composition structure of a guide template in a preferred embodiment of the disclosure.

As shown in FIG. 2, in order to shape the guide template 60, the guide template 60 includes a weaving plate 60*a*. A plurality of uniformly-distributed first through holes are provided on the weaving plate 60*a*. The weaving plate 60*a* is supported by a rectangular frame 59. A perforated plate 65 is set below the weaving plate 60*a*. The weaving plate 60*a* is provided with a plurality of second through holes coaxially corresponding to the first through holes. A plurality of guide columns 61 with adjustable heights are set below the perforated plate 65. The upper ends of the guide columns 61 pass through the first through holes and the second through holes to locate above the weaving plate 60*a*. The cylindrical guiders 62 are cylindrical sleeves which are sleeved on the guide columns 61 and provided with optional heights.

Figure 3:
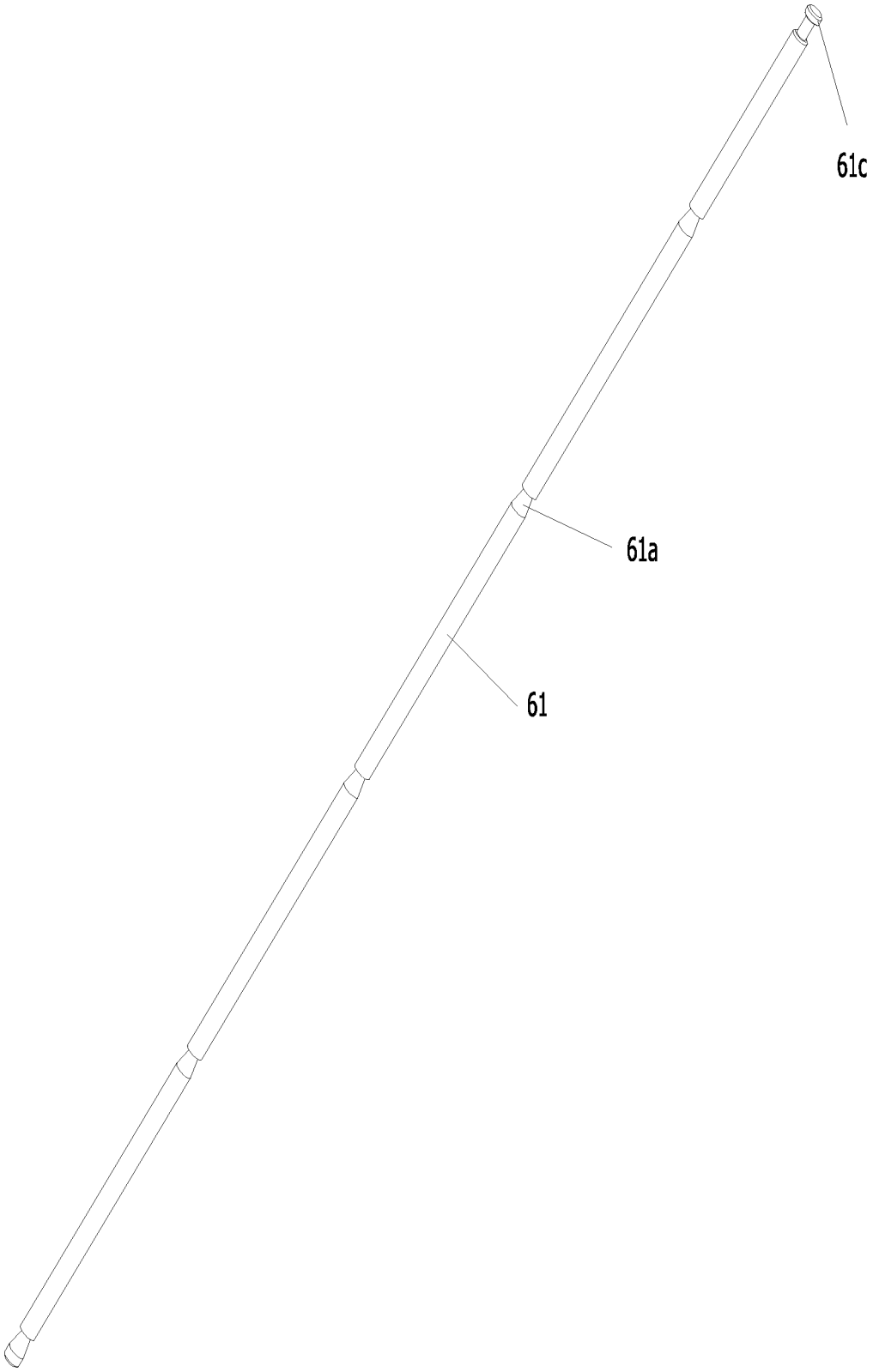
FIG. 3 is a structural diagram illustrating a guider support rod in a preferred embodiment of the disclosure.

As shown in FIG. 3, a guide column 61 is provided with clamping grooves 61*a* distributed axially at equal intervals. The clamping grooves 61*a* may be formed by the conical portions of the guide column 61 and flanges set on the small-diameter ends of the conical portions. The upper end of the guide column 61 are provided with a first annular platform 61*c* extending outwards along the radial direction. The portion below the first annular platform 61*c* may be grabbed by a clamping device to move the guide column 61.

Figure 4:
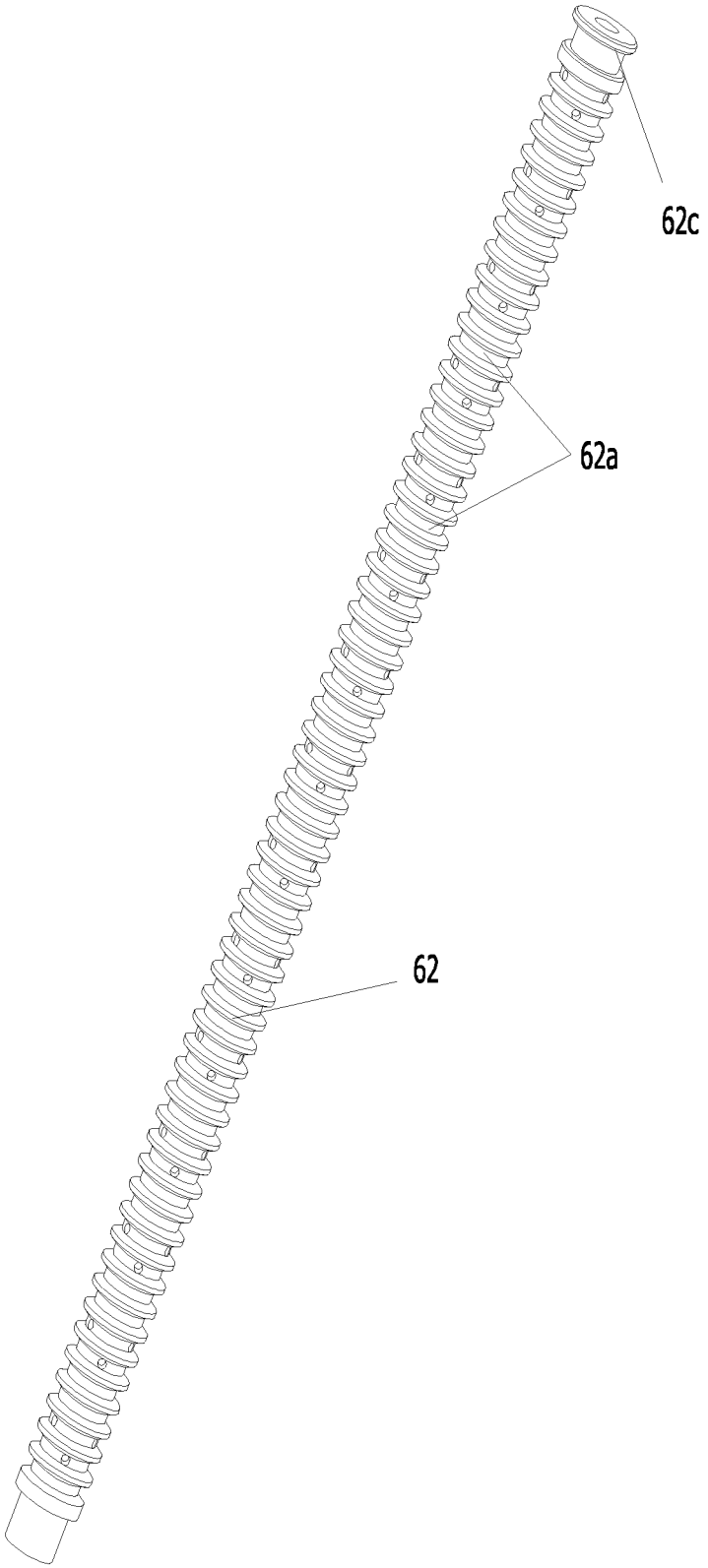
FIG. 4 is a schematic diagram illustrating a surface structure of a cylindrical guider in a preferred embodiment of the disclosure.

As shown in FIG. 4, in order to locate the weave fibers to the surfaces of a cylindrical guider 62, the peripheries of the cylindrical guider 62 are provided with a plurality of layers of ring grooves 62*a* for limiting the positions of the weave fibers. Each ring groove 62*a* is formed by a plurality of flanges extending outwards along the radial direction on the cylindrical guider 62. In order to grab the cylindrical guider 62 conveniently, the upper end of the cylindrical guider 62 may be provided with a second annular platform 62*c* extending outwards along the radial direction, and the portion below the second annular platform 62*c* may be clamped by a chuck to clamp the cylindrical guider 62.

Figure 5:
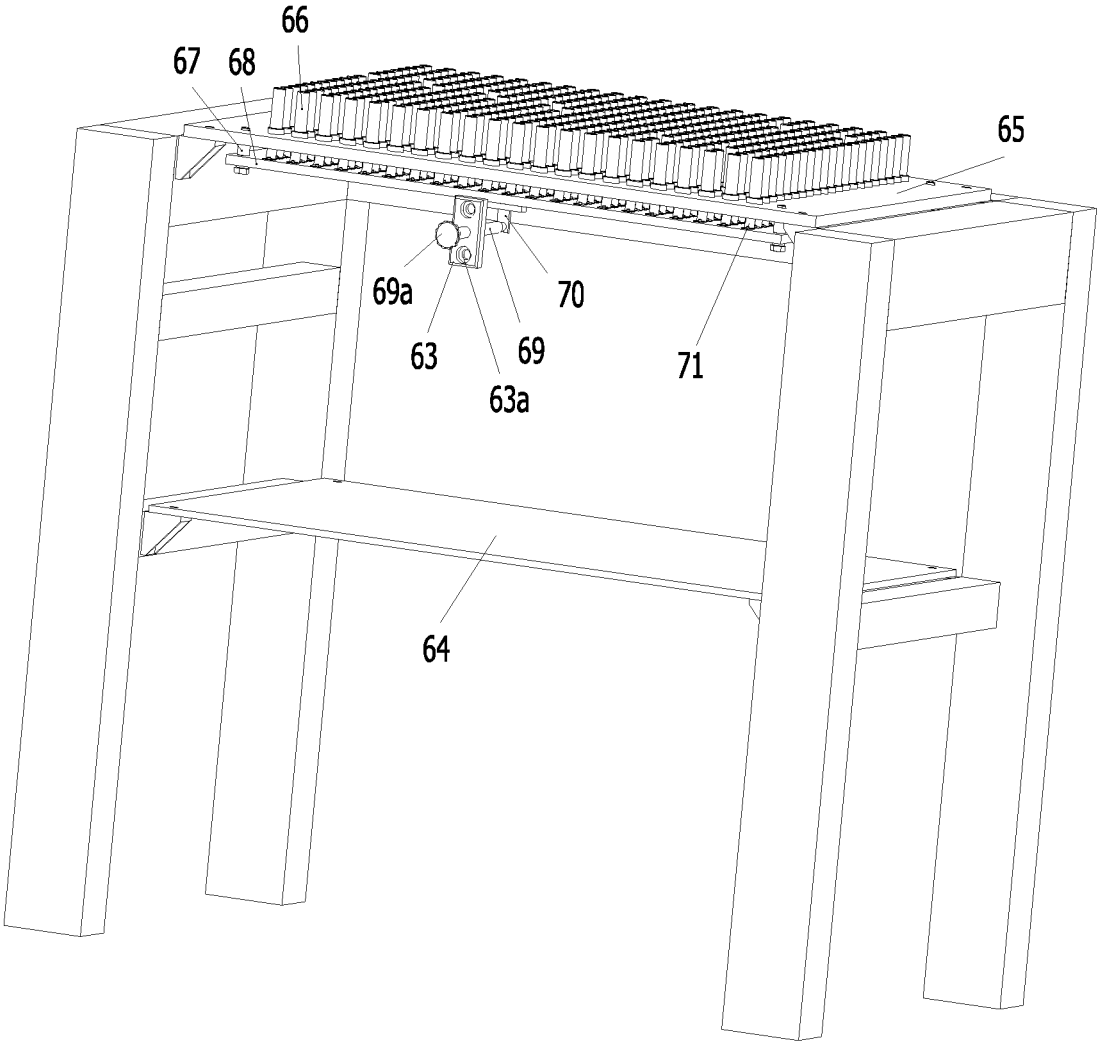
FIG. 5 is a schematic diagram illustrating an adjusting structure of a moveable adjusting plate below a guide template in a preferred embodiment of the disclosure.

As shown in FIG. 5, a moveable adjusting plate 68 is set below the perforated plate 65. A guide column support plate 64 that is static relative to the perforated plate 65 is set below the moveable adjusting plate 68. When all the guide columns 61 fall (see FIG. 2), the lower ends of the guide columns 61 are located on the guide column support plate 64. The moveable adjusting plate 68 is sliding relative to the perforated plate 65. A plurality of elongated and round apertures 72 (see FIG. 6) opposite to the through holes of the perforated plate 65 are set on the moveable adjusting plate 68. The guide columns 61 pass through the elongated and round apertures 72 and move in the elongated and round apertures 72 with the movement of the moveable adjusting plate 68.

locking members matched with the clamping grooves 61*a* are set on the moveable adjusting plate 68. The moveable adjusting plate 68 is provided with alocking position to match the locking members with the clamping grooves 61*a* so as to lock the heights of the guide columns 61 and an unlocking position to separate the locking members and the clamping grooves 61*a* so as to continue to adjust the heights of the guide columns 61.

A first support framework 58 (see FIG. 2) is set below the moveable adjusting plate 68. The first support frame 58 is provided with a first support frame 58*a* located on the periphery of the moveable adjusting plate 68. See FIG. 5, a locating plate 63 is set on the first support frame 58*a*. Internal threaded holes are set on the locating plate 63. Adjusting screw rod 69 matched with one of the internal threaded holes are provided in the internal threaded hole. The telescopic end of the adjusting screw rod 69 are fixedly connected with the moveable adjusting plate 65.

Figure 6:
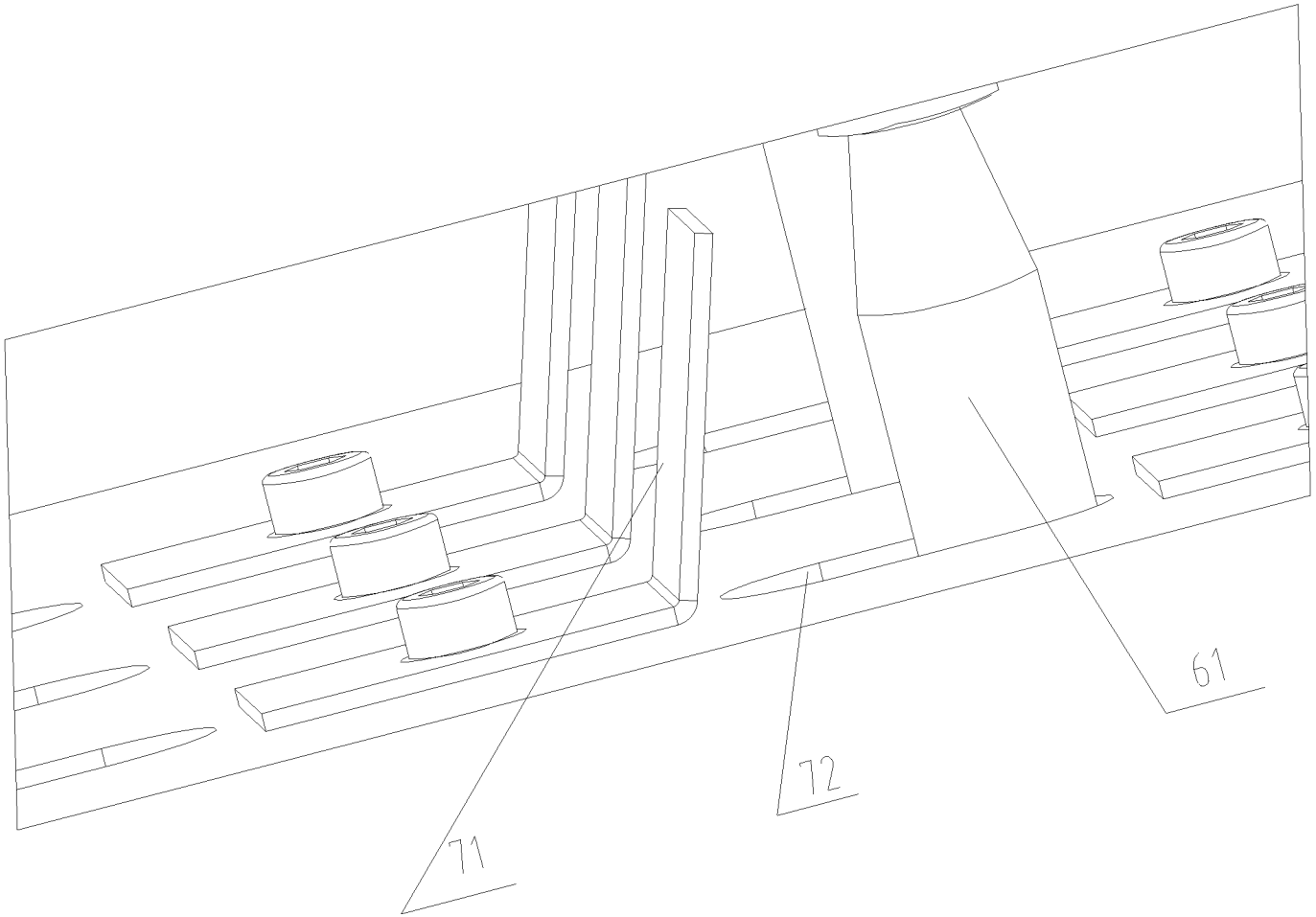
FIG. 6 is a schematic diagram illustrating a position relation between a locking member and a clamping groove during free falling of a guider support rod after weaving.
Figure 7:
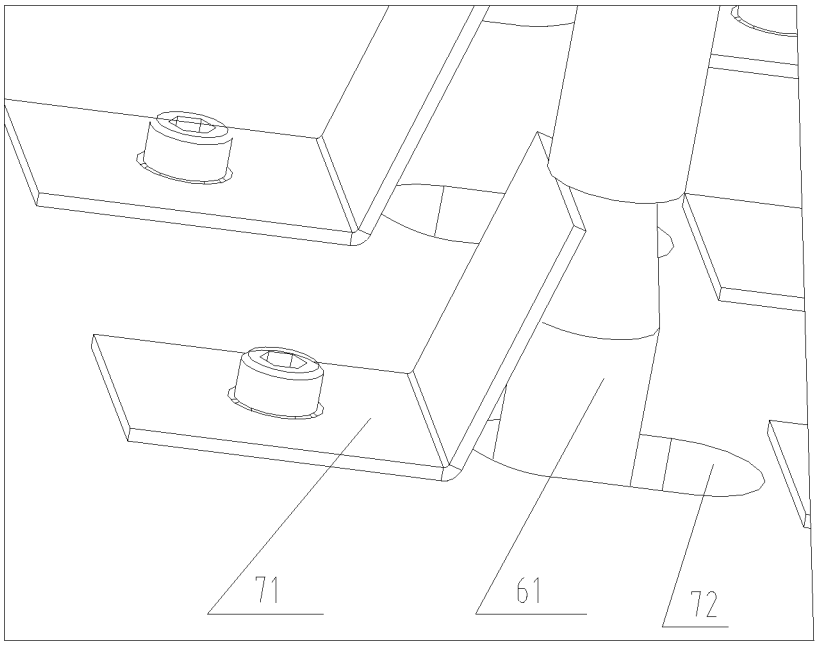
FIG. 7 is a schematic diagram illustrating a position relation between a locking member and a clamping groove when a moveable adjusting plate is located in a locking position.

As shown in FIG. 6 and FIG. 7, the locking member may be a leaf spring 71 set at an end of the extension direction of the elongated and round aperture 72 and obliquely extending to the guide column 61 located in the elongated and round aperture 72.

See FIG. 5, the bottom surface of the moveable adjusting plate 68 is fixed with a shifting yoke 70. The first end of the adjusting screw rod 69 are fixedly connected with the shifting yoke 70 and the second end of the adjusting screw rod 69 are provided with adjusting handle 69*a*. The adjusting screw rod 69 are rotated by using the adjusting handle 69*a*, and the adjusting screw rod 69 stretch in the internal threaded hole of the locating plate 63 to drive the shifting yoke 70 to move to further drive the moveable adjusting plate 68 to move so that the leaf springs 71 is matched with the clamping grooves 61*a* to lock the guide columns 61. For the time being, the guide columns 61 can be only elevated and cannot be lowered. After weaving a component, the relative linear motion of the adjusting screw rod 69 and the locating plate 63 drives the moveable adjusting plate 68 to move in a straight line so that the guide columns 61 can fall freely onto the guide column support plate 64 instead of being clamped tightly by the leaf springs 71.

A plurality of connecting holes 63*a* configured to connect the first support frame 58*a* is further set on the locating plate 63.

See FIG. 2, the first support framework 58 includes four first support legs 58*c*, and the guide column support plate 64 is located between the four first support legs 58*c*.

A plurality of locating sleeves 66 (see FIG. 2 and FIG. 5) coaxially matched with the second through holes are further provided on the perforated plate 65, and the guide columns 61 pass through the locating sleeves 66.

The layout size or shape of the cylindrical guiders 62 in the guide template 60 may be changed according to the external feature of a pre-woven component. The heights of the guide columns 61 for supporting the cylindrical guiders 62 can be adjusted according to the external feature of the pre-woven component. The perforated plate 65 is fixed on the first support framework 58. locating sleeves 66 sleeved on the periphery of the guide columns 61 are installed on the perforated plate 65 to improve the rigidity of the guide columns 61. The moveable adjusting plate 68 is suspended below the perforated plate 65 by a plurality of perforated plate mounting bases 67 (see FIG. 5) fixed with the perforated plate 65, and may make a linear motion relative to the perforated plate 65. The leaf springs 71 are matched with the elongated and round apertures 72 on the moveable adjusting plate 68 to clamp or release the guide columns 61.

The cylindrical guiders 62 with different heights can be stored on a cylindrical guider storage plate 83 (see FIG. 1). The cylindrical guiders 62 with different heights are selected and sleeved on the matrix of the guide columns 62 according to the external features of the woven component to perform approximate weaving.

Figure 8:
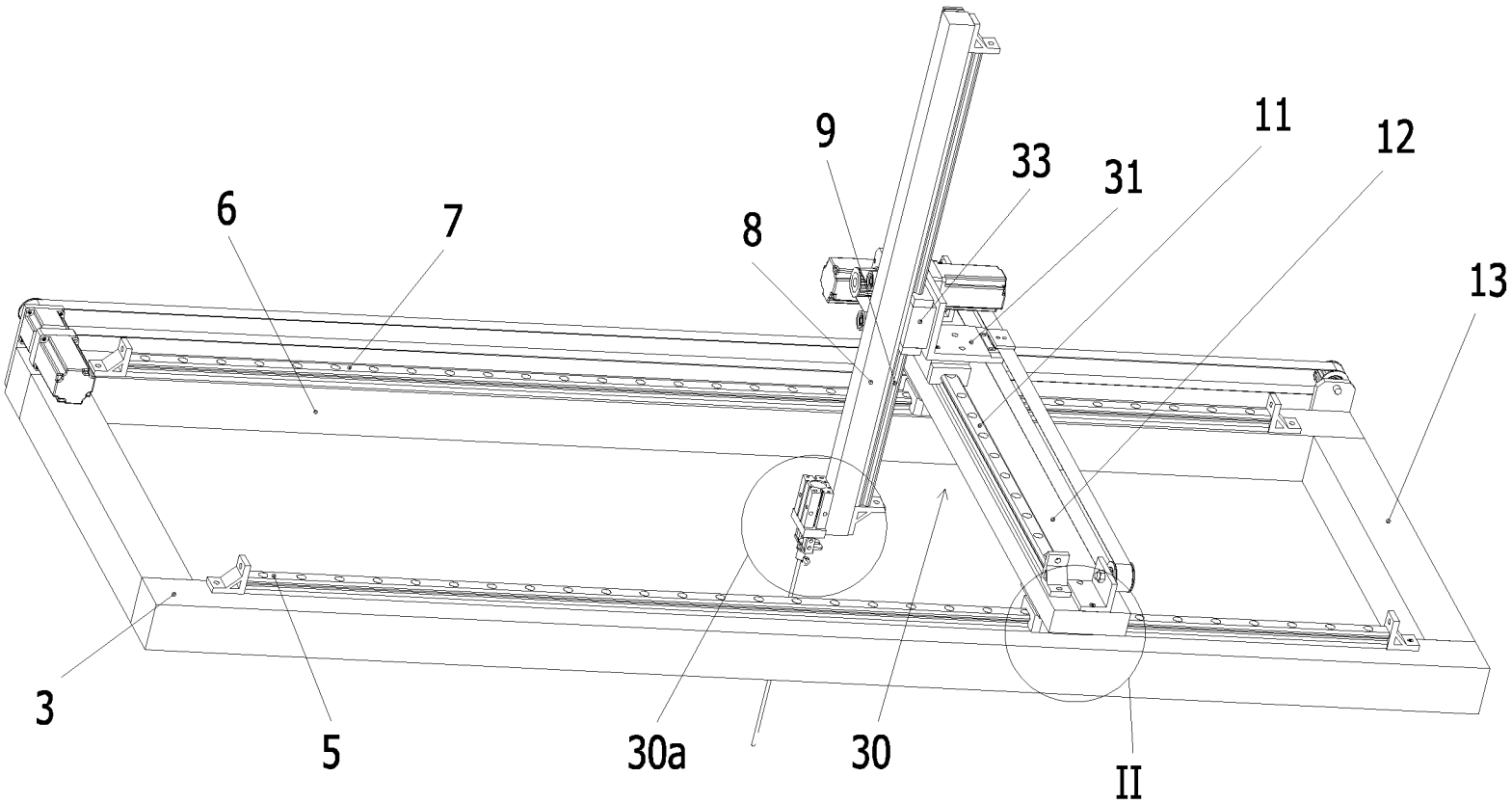
FIG. 8 is a structural diagram of an electrical control three-dimensional motion mechanism in a preferred embodiment of the disclosure.

As shown in FIG. 8, the electrical control three-dimensional motion mechanism 30 further includes: an X axis motion unit including an X supporter extending along a first direction and an X axis guide rail set on the X axis supporter and an X axis synchronous belt motion mechanism set along the X axis guide rail and provided an X axis slider; a Y axis motion unit including a Y axis supporter 12 connected with the X axis slider and extending along a second direction vertical to the first direction and a Y axis guide rail 11 set on the Y axis supporter 12 and a Y axis synchronous belt motion mechanism set along the Y axis guide rail 11 and provided with a Y axis slider 31; a Z axis motion unit including a Z axis supporter 8 extending along a third direction vertical to the plane formed by the first direction and the second direction and a Z axis guide rail 9 set on the Z axis supporter 8 and a Z axis synchronous belt motion mechanism set along the Z axis guide rail 9 and provided with a Z axis slider 33 which is fixedly connected with the Y axis slider 31, wherein a three-dimensional motion output terminal 30*a* is formed at the lower end of the Z axis supporter 8.

Figure 9:
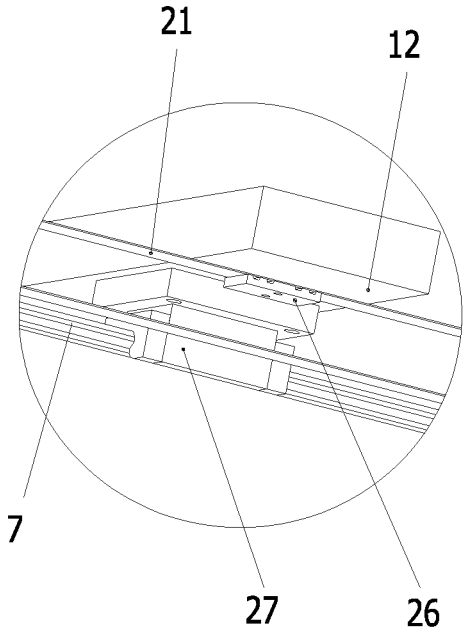
FIG. 9 is a schematic diagram illustrating an enlarged structure of Part II in FIG. 8.
Figure 11:
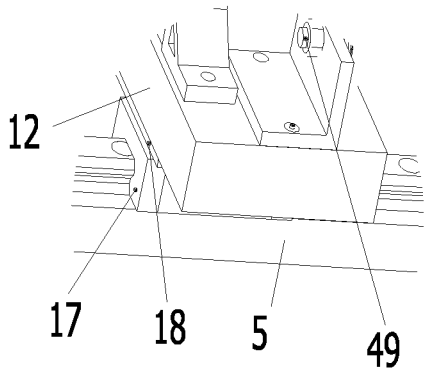
FIG. 11 is a structural diagram illustrating partial enlargement in an A direction in FIG. 10.

In order to improve the support strength of the electrical control three-dimensional motion unit, the X axis supporter may include a first supporter 3 and a second supporter 6 in parallel. The X axis guide rail includes a first guide rail 5 and a second guide rail 7 set on the first supporter 3 and the second supporter 6, respectively. A first synchronous belt motion mechanism and a second synchronous belt motion mechanism are set on the first guide rail 5 and the second guide rail 7, respectively. The first synchronous belt motion mechanism and the second synchronous belt motion mechanism are provided with a first slider 17 (see FIG. 11) and a second slider 27 (see FIG. 9), respectively. The two ends of the Y axis supporter 12 are connected with the first slider 17 and the second slider 27, respectively.

Actually, motion units that are more multi-dimensional, including a four-axis motion unit or a five-axis motion unit etc. can be also applied so as to realize multi-dimensional weaving of composite materials.

More specifically, the X axis motion system includes the first guide rail 5 and the second guide rail 7 in parallel. The first guide rail is supported by the first supporter 3 and the second guide rail 7 is supported by the second supporter 6. There is a predetermined distance between the first supporter 3 and the second supporter 6. The distance between the first supporter 3 and the second supporter 6 can be determined by the width of the guide template 60 (see FIG. 1). The distance between the first supporter 3 and the second supporter 6 may be set relatively long and the size of the guide template 60 is increased correspondingly to adapt to the space required to weave a large component. The first slider 17 is set on the first guide rail 5. The second slider 27 is set on the second guide rail 7. The first supporter 3 and the second supporter 6 are connected by a transverse connecting rod 13 (see FIG. 8). One end of the Y axis supporter 12 can be connected with the first slider 17 by an XY connecting plate 18 (see FIG. 11). The X axis synchronous belt 21 in the X axis synchronous belt mechanism is connected to the other end of the Y axis supporter 12 by an X axis synchronous belt fixing plate 26.

Figure 10:
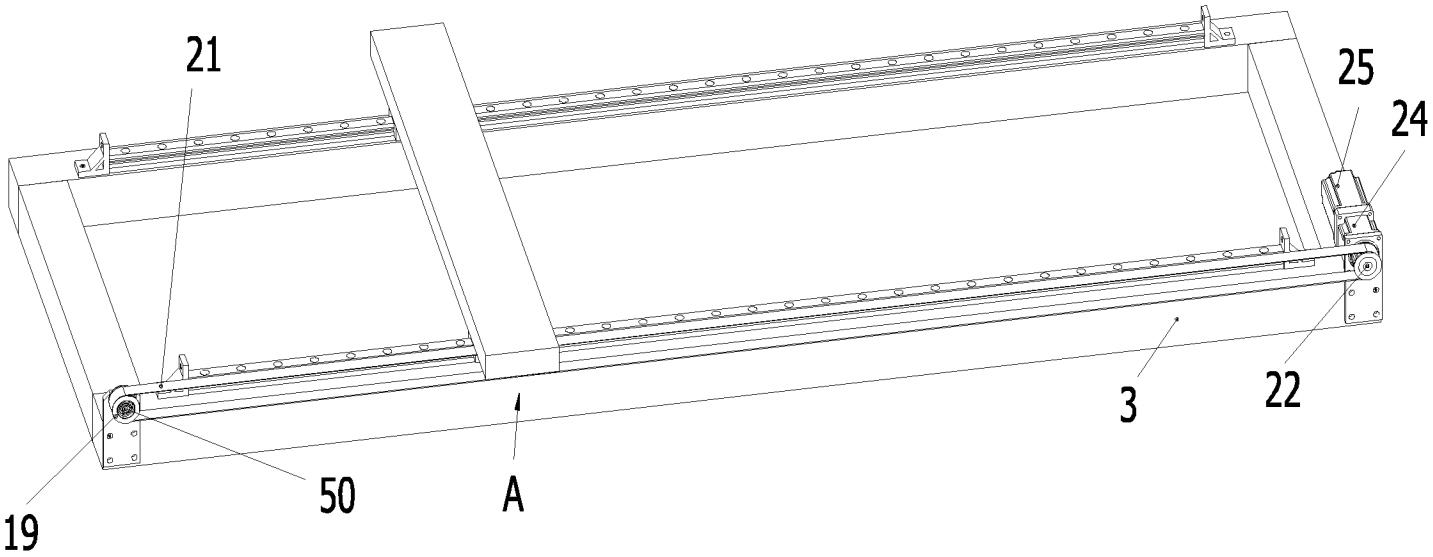
FIG. 10 is a structural diagram of an X axis motion unit in an embodiment of the disclosure.

As shown in FIG. 10, an X axis driving synchronous belt wheel 22 is connected with an X axis decelerator 24 fixed on the first supporter 3 by a rolling bearing. An X driven synchronous belt wheel 19 is installed on an X axis driven wheel spindle 50 by a bearing and a retainer ring at the end of the bearing. The X axis driven wheel spindle 50 is tightened on the first supporter 3 by threads. The X axis motion unit takes an X axis motor 25 and the X axis decelerator 24 as the power units drives the X axis driving synchronous belt wheel 22 to function as a drive unit by the X axis motor 25 so as to drive the first slider 17 and the second slider 27 to move on the first guide rail 5 and the second guide rail 7.

Figure 12:
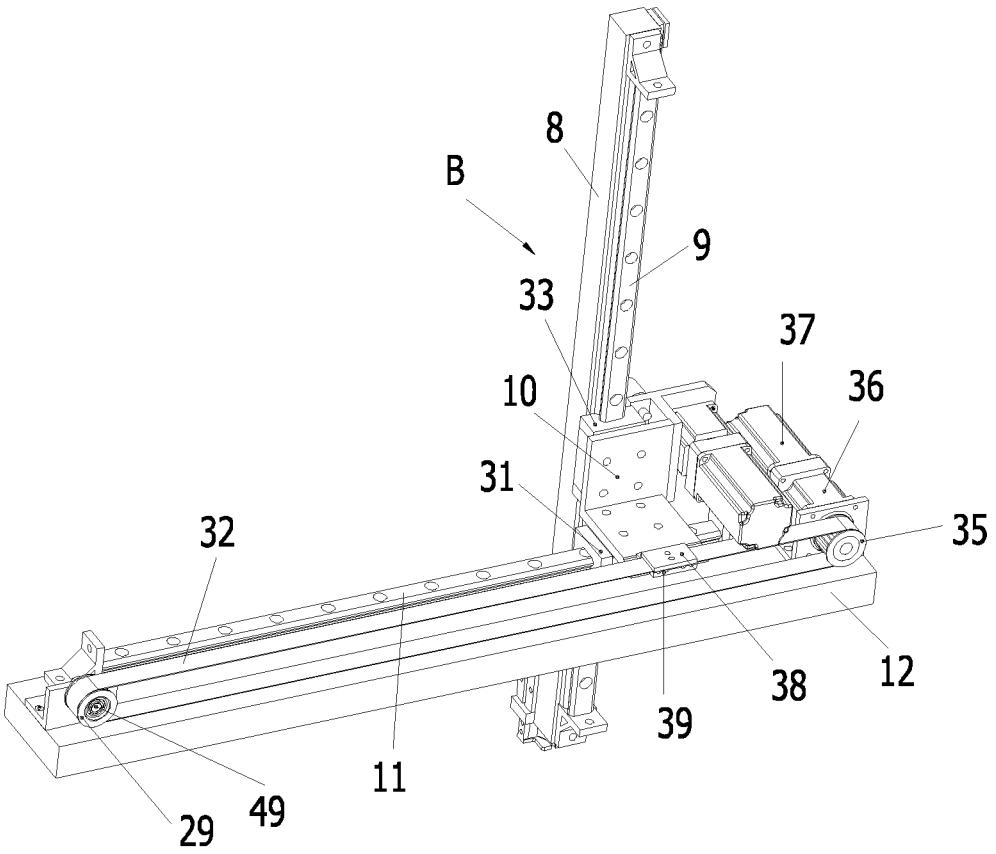
FIG. 12 is a structural diagram of a Y axis motion unit in a preferred embodiment of the disclosure.

As shown in FIG. 12, the Z axis motion unit includes the Z axis guide rail 9. The Z axis guide rail 9 is supported by the Z axis supporter 8. The Z axis slider 33 is set on the Z axis guide rail 9. The Z axis slider 33 is connected with the Y axis slider 31 by a YZ orthogonal connecting plate 10. A Y axis synchronous belt joint pressing plate 38 in the Y axis synchronous belt mechanism presses the Y axis synchronous belt 32 on a Y axis synchronous belt fixing plate 39 and is fixed on the YZ orthogonal connecting plate 10. A Y axis driving synchronous belt wheel 35 is connected with a Y axis decelerator 36 on the Y axis supporter 12 by a rolling bearing. A Y axis driven synchronous belt wheel 29 is installed on a Y axis driven wheel spindle 49 by a bearing and a retainer ring at the end of the bearing. The Y axis driven wheel spindle 49 is secured on the Y axis supporter 12 (see FIG. 9). The Y axis motion system takes a Y motor 37 and the Y axis decelerator 36 as the power units, and takes the Y axis motor 37 and the Y axis driving synchronous belt wheel 35 as the drive units so as to drive the Y axis slider 31 to move on the Y axis guide rail 11.

Figure 13:
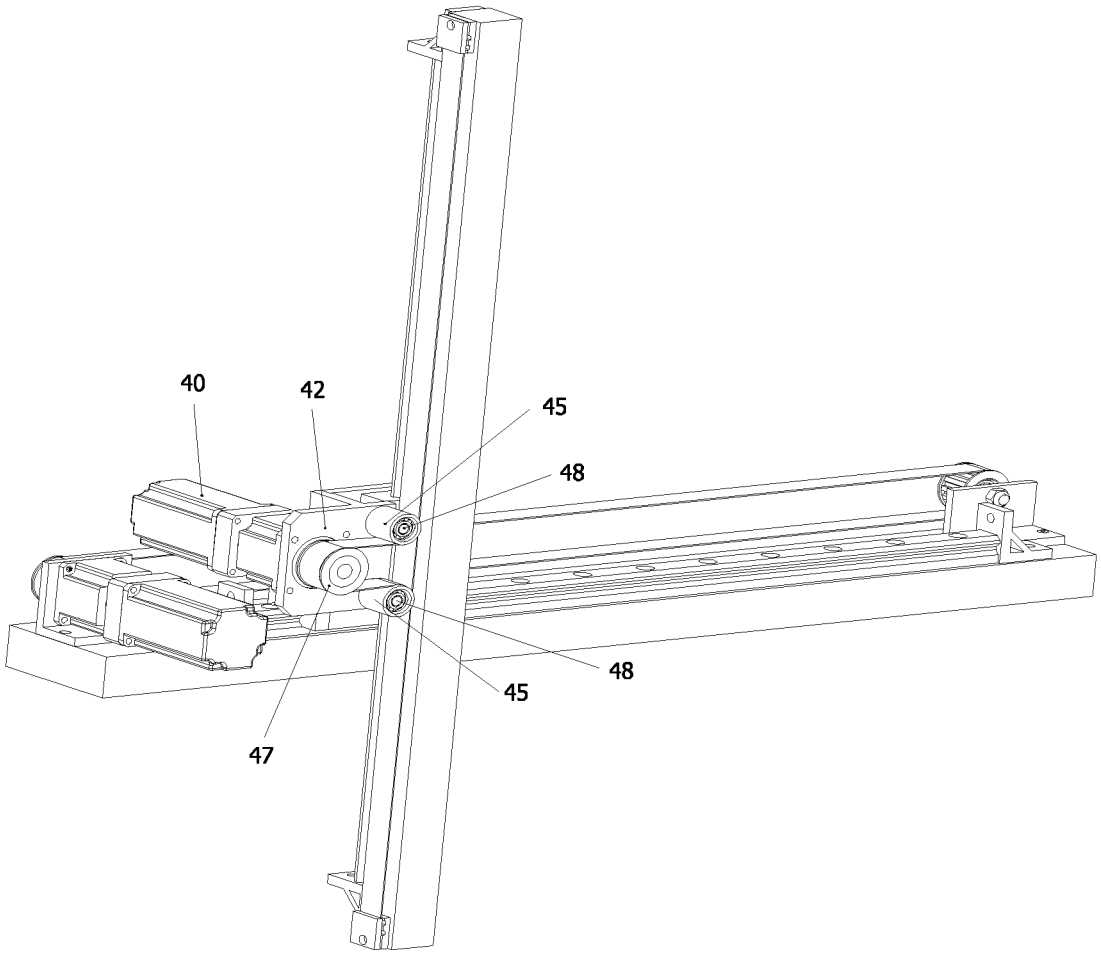
FIG. 13 is a structural diagram in a B direction in FIG. 12.

As shown in FIG. 13, a Z axis driving synchronous belt wheel base 42 is fixed on the orthogonal connecting plate 10. A Z axis driving synchronous belt wheel 47 is connected with a Z axis decelerator 40 fixed on the Z axis driving synchronous belt wheel base 42 by a rolling bearing. The direction of Z axis driving synchronous belt wheel 47 is changed by a synchronous belt pulley 45. The synchronous belt pulley 45 is installed on a synchronous belt pulley shaft 48 by a bearing and a retainer ring at the end of the bearing. The synchronous belt pulley shaft 48 is secured on the Z axis driving synchronous belt wheel base 42 by threads.

See FIG. 1, the multi-dimensional weaving shaping machine of composite materials of the disclosure further includes: a cylindrical guider storage shelf 80 located at the first side of the guide template 60. The cylindrical guider storage shelf 80 includes a guider storage support bracket 81 and a storage plate 83 set on the guider storage support bracket 81. A plurality of cylindrical guiders 62 with different heights are pre-stored on the storage plate 83.

A plurality of uniformly-distributed threaded holes are provided on the storage plate 83. Storage support rods (not shown in the figure) for supporting the cylindrical guiders 62 are provided in the threaded holes. The lower ends of the storage support rods are provided with external threads matched with the threaded holes.

Figure 14:
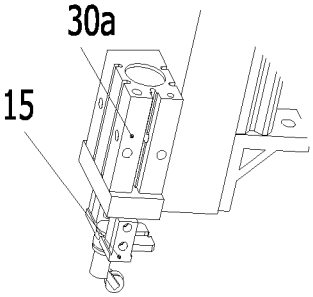
FIG. 14 is a structural diagram illustrating partial enlargement of 30*a* in FIG. 8.

As shown in FIG. 14, a pneumatic chuck 15 for clamping the weaving needle and the cylindrical guiders 62 pre-stored on the storage plate 83 is set on the three-dimensional motion output terminal 30*a*. The pneumatic chuck 15 may apply an existing standard component.

See FIG. 1, a weaving mechanism 50 of the multi-dimensional weaving shaping machine of composite materials of the disclosure further includes a fiber yarn feeding and tensioning mechanism located at the second side of the guide template 60.

Figure 15:
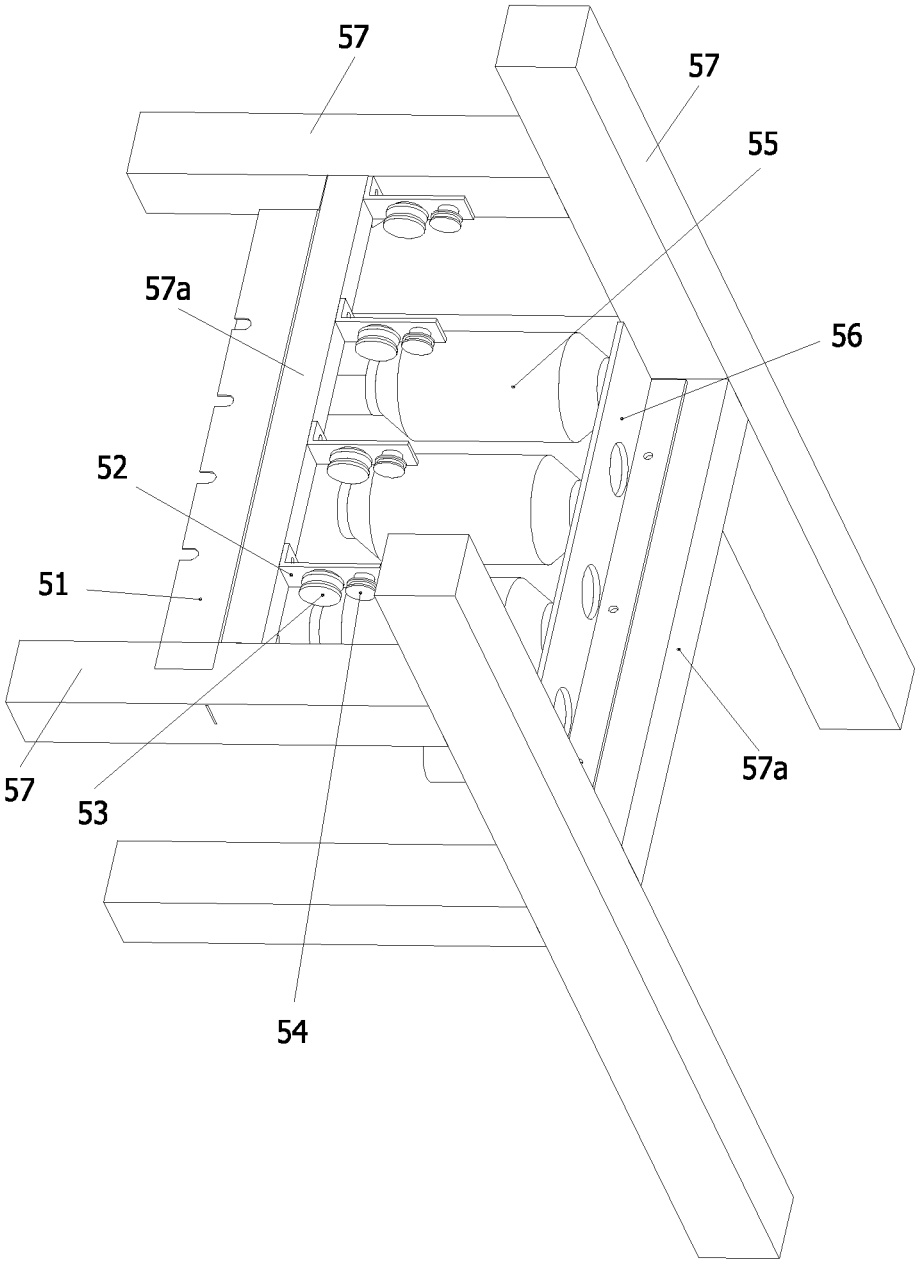
FIG. 15 is a schematic diagram illustrating partial enlargement of a fiber yarn feeding and tensioning mechanism in a preferred embodiment of the disclosure.

As shown in FIG. 15, the fiber yarn feeding and tensioning mechanism includes: a third bracket 57; a fiber roll installation bracket 56 set on a support beam 57*a* of the third bracket 57 and provided with support rods for supporting fiber rolls 55; tension pulley base plates 52 set on a support beam 57*a* and located on the top of the ramp of the fiber roll installation bracket 56. A tension pulley 53 for providing fiber yarns to the weaving needle and a guide pulley 54 are provided on each of the tension pulley base plates. The fiber roll installation bracket 56 is installed on the support beam 57*a* by bolts. The fiber rolls 55 are placed transversely on the fiber roll installation bracket 56. The tension pulley base plates 52 and a weaving needle base 51 are installed on another support beam 57*a* by bolts. The tension pulley 53 and the guide pulley 54 are installed on each of the tension pulley base plates 52. After being guided by the guide pulley 54, the fiber yarns of the fiber roll 55 are tensioned by the tension pulley 53 and carried by the weaving needle 14 (see FIG. 1) to be woven.

The above are only the preferred embodiments of the disclosure and not intended to limit the disclosure. For those skilled in the art, the disclosure may have various modifications and changes. Any modifications, equivalent replacements and improvements etc. made within the spirit and principle of the disclosure shall be included in the protection scope of the disclosure.

The invention claimed is:

1. A multi-dimensional weaving shaping machine of composite materials, wherein it comprises:

a guide template comprising a plurality of cylindrical guiders arranged according to the geometrical shape of a prefabricated member;

an electrical control three-dimensional motion mechanism located above the guide template, and the electrical control three-dimensional motion mechanism comprises: a control signal receiving terminal configured to receive motion control signals corresponding to the geometrical shape of the prefabricated member; and a three-dimensional motion output terminal configured to form a motion track according to the motion control signals; and a weaving mechanism comprising: a weaving needle being connected with the three-dimensional motion output terminal for driving weave fibers to move among the cylindrical guiders along the motion track so that the weave fibers are distributed among the cylindrical guiders according to the geometrical shape of the prefabricated member.

2. The multi-dimensional weaving shaping machine of composite materials according to claim 1, wherein the guide template comprises a weaving plate; a plurality of uniformly-distributed first through holes are provided on the weaving plate; a perforated plate is set below the weaving plate; a plurality of guide columns of which the heights are adjustable are set below the perforated plate; the perforated plate is provided with a plurality of second through holes coaxially corresponding to the first through holes; the guide columns pass through the first through holes and the second through holes; the cylindrical guiders are cylindrical sleeves which are sleeved on the guide columns and provided with optional heights.

3. The multi-dimensional weaving shaping machine of composite materials according to claim 2, wherein a pneumatic chuck for clamping the weaving needle, the cylindrical guiders or the guide columns is set on the three-dimensional motion output terminal.

4. The multi-dimensional weaving shaping machine of composite materials according to claim 2, wherein each of the guide columns is provided with clamping grooves distributed axially at equal intervals; a moveable adjusting plate is set below the perforated plate; a guide column support plate that is static relative to the perforated plate is set below the moveable adjusting plate; the moveable adjusting plate is capable of sliding relative to the perforated plate; a plurality of elongated and rounded apertures opposite to the second through holes of the perforated plate are set on the moveable adjusting plate; the guide columns pass through the elongated and rounded apertures and move in the elongated and rounded apertures with the movement of the moveable adjusting plate.

5. The multi-dimensional weaving shaping machine of composite materials according to claim 4, wherein locking members matched with the clamping grooves are set on the moveable adjusting plate; the moveable adjusting plate has a locking position to match the locking members with the clamping grooves so as to lock the heights of the guide columns and an unlocking position to separate the locking members and the clamping grooves.

6. The multi-dimensional weaving shaping machine of composite materials according to claim 5, wherein the locking member is a leaf spring set at an end of the extension direction of the elongated and round aperture and obliquely extending to the guide column located in the elongated and round aperture; the clamping grooves are formed by the conical portions of the guide column and flanges set on the small-diameter ends of the conical portions.

7. The multi-dimensional weaving shaping machine of composite materials according to claim 4, wherein a first support framework is set below the moveable adjusting plate; the first support frame is provided with a first support frame located on the periphery of the moveable adjusting plate; a locating plate is set on the first support frame; provided at a side face of the locating plate is an adjusting screw rod extending horizontally; the first end of the adjusting screw rod is fixedly connected with the moveable adjusting plate.

8. The multi-dimensional weaving shaping machine of composite materials according to claim 7, wherein the bottom surface of the moveable adjusting plate is provided with a shifting yoke; the first end of the adjusting screw rod is fixedly connected with the moveable adjusting plate through the shifting yoke, and the second end of the adjusting screw rod is provided with an adjusting handle.

9. The multi-dimensional weaving shaping machine of composite materials according to claim 7, wherein the locating plate is further provided with a connecting hole configured to connect the first support frame.

10. The multi-dimensional weaving shaping machine of composite materials according to claim 7, wherein the first support framework comprises four first support legs, and the guide column support plate is located between the four first support legs.

11. The multi-dimensional weaving shaping machine of composite materials according to claim 2, wherein the perforated plate is further provided with a plurality of locating sleeves coaxially matched with the second through holes, and the guide columns pass through the locating sleeves.

12. The multi-dimensional weaving shaping machine of composite materials according to claim 2, wherein the upper end of the guide column is provided with first annular platform extending outwards along the radial direction.

13. The multi-dimensional weaving shaping machine of composite materials according to claim 1, wherein provided around the periphery of the cylindrical guider is a plurality of ring grooves for limiting the positions of the weave fibers.

14. The multi-dimensional weaving shaping machine of composite materials according to claim 1, wherein provided at the upper end of the cylindrical guider is a second annular platform extending outwards along the radial direction.

15. The multi-dimensional weaving shaping machine of composite materials according to claim 1, wherein the electrical control three-dimensional motion mechanism further comprises:

an X axis motion unit comprising:
- an X supporter extending along a first direction;
- an X axis guide rail set on the X axis supporter;
- an X axis synchronous belt motion mechanism set along the X axis guide rail and provided with an X axis slider;

a Y axis motion unit comprising:
- a Y axis supporter connected with the X axis slider and extending along a second direction vertical to the first direction;
- a Y axis guide rail set on the Y axis supporter;
- a Y axis synchronous belt motion mechanism set along the Y axis guide rail and provided with a Y axis slider;

a Z axis motion unit comprising:
- a Z axis supporter extending along a third direction vertical to the plane formed by the first direction and the second direction;
- a Z axis guide rail set on the Z axis supporter;
- a Z axis synchronous belt motion mechanism set along the Z axis guide rail and provided with a Z axis slider; the Z axis slider is fixedly connected with the Y axis slider, wherein a three-dimensional motion output terminal is formed at the lower end of the Z axis supporter.

16. The multi-dimensional weaving shaping machine of composite materials according to claim 15, wherein, the X axis supporter comprises a first supporter and a second supporter in parallel; the X axis guide rail comprises a first guide rail and a second guide rail set on the first supporter and the second supporter, respectively; the X axis synchronous belt motion mechanism is set on the first supporter; the synchronous belt of the X axis synchronous belt motion mechanism is connected with the first end of the Y axis supporter;

the X axis slider comprises a first slider located on the first guide rail and a second slider located on the second guide trail;

the first slider and the second slider are located below the first end and the second end of the Y axis supporter, respectively.

17. The multi-dimensional weaving shaping machine of composite materials according to any one of claims 1 to 16, wherein it further comprises a cylindrical guider storage shelf located at the first side of the guide template; the cylindrical guider storage shelf comprises a guider storage support bracket and a storage plate set on the guider storage support bracket; a plurality of cylindrical guiders with different heights are pre-stored on the storage plate.

18. The multi-dimensional weaving shaping machine of composite materials according to claim 17, wherein a plurality of uniformly-distributed threaded holes are provided on the storage plate; storage support rods for supporting the cylindrical guiders are provided in the threaded holes; the lower ends of the storage support rods are provided with external threads matched with the threaded holes.

19. The multi-dimensional weaving shaping machine of composite materials according to claim 18, wherein the weaving mechanism further comprises a fiber yarn feeding and tensioning mechanism located at the second side of the guide template.

20. The multi-dimensional weaving shaping machine of composite materials according to claim 19, wherein the fiber yarn feeding and tensioning mechanism comprises:

a third bracket;

a fiber roll installation bracket set on a support beam of the third bracket and provided with support rods for supporting fiber rolls;

tension pulley base plates set on the support beam of the third bracket; a tension pulley for providing fiber yarns to the weaving needle and a guide pulley are provided on each of the tension pulley base plate.

21. The multi-dimensional weaving shaping machine of composite materials according to claim 20, the fiber yarn feeding and tensioning mechanism further comprises a weaving needle base for storing the weaving needle and the weaving needle base is located on one side of the tension pulley base plate.

* * * * *